US011724519B2

(12) United States Patent
Hill et al.

(10) Patent No.: US 11,724,519 B2
(45) Date of Patent: Aug. 15, 2023

(54) DIGITAL PRINTING SYSTEM AND METHOD

(71) Applicant: William P. Young Company, Plymouth, MI (US)

(72) Inventors: Kenneth E. Hill, Livonia, MI (US); Ronald L. Uptergrove, Northville, MI (US)

(73) Assignee: William P. Young Company, Plymouth, MI (US)

( * ) Notice: Subject to any disclaimer, the term of this patent is extended or adjusted under 35 U.S.C. 154(b) by 0 days.

(21) Appl. No.: 16/694,069

(22) Filed: Nov. 25, 2019

(65) Prior Publication Data

US 2020/0164669 A1 May 28, 2020

Related U.S. Application Data

(60) Provisional application No. 62/771,303, filed on Nov. 26, 2018.

(51) Int. Cl.

| | |
|---|---|
| ***B41J 3/407*** | (2006.01) |
| ***B41J 29/06*** | (2006.01) |
| ***B41M 5/00*** | (2006.01) |
| ***B41J 11/00*** | (2006.01) |

(52) U.S. Cl.

CPC ..... *B41J 3/4073* (2013.01); *B41J 3/40731* (2020.08); *B41J 3/40733* (2020.08); *B41J 11/00214* (2021.01); *B41J 29/06* (2013.01); *B41M 5/0082* (2013.01)

(58) Field of Classification Search

None

See application file for complete search history.

(56) References Cited

U.S. PATENT DOCUMENTS

| | | | | |
|---|---|---|---|---|
| 9,375,927 | B1 * | 6/2016 | Perego | B41J 3/4073 |
| 2003/0210299 | A1 * | 11/2003 | Min | B41J 2/1632 347/61 |
| 2004/0099160 | A1 * | 5/2004 | Tweedy | B41F 15/0872 101/41 |
| 2013/0269551 | A1 * | 10/2013 | Till | B41J 3/407 101/40.1 |
| 2014/0028771 | A1 * | 1/2014 | Yamada | B41J 2/2117 347/104 |
| 2015/0298467 | A1 * | 10/2015 | Cofler | B41J 3/4073 347/16 |

* cited by examiner

*Primary Examiner* — Erica S Lin

(74) *Attorney, Agent, or Firm* — Fishman Stewart PLLC

(57) ABSTRACT

A digital printing system includes a track and a plurality of print heads, wherein the system is configured to index a plurality of containers to or through a plurality of process locations. In embodiments, the track is configured to convey a plurality of containers to or through the plurality of process locations, and the plurality of print heads are configured for digital printing on the plurality of containers.

25 Claims, 9 Drawing Sheets

DIGITAL PRINTING SYSTEM AND METHOD

CROSS-REFERENCE TO RELATED APPLICATION

This application claims the benefit of priority to U.S. Provisional Application No. 62/771,303, filed Nov. 26, 2018, the entire disclosure of which is incorporated herein by reference.

TECHNICAL FIELD

The present disclosure generally relates to digital printing systems and methods, including digital printing systems and methods involving linear and/or indexed conveyance, as well as controlled and/or modular components.

BACKGROUND

There is a desire for solutions and/or options that, among other things, can further improve or optimize the digital printing of containers, including the digital printing of plastic containers and glass containers at relatively high speeds, with improved flexibility, and/or with higher throughput. The foregoing discussion is intended only to illustrate examples of the present field and should not be taken as a disavowal of scope.

SUMMARY

A digital printing system includes a track for conveying a plurality of containers to or through a plurality of process locations, and a plurality of print heads configured for digital printing on the plurality of containers. In embodiments, which may have linear paths or portions thereof, the system may be configured to index sets of the plurality of containers (e.g., groups of two or three containers) to or through the plurality of process locations—which may involve print heads or other forms of treatment or processing.

The foregoing and other aspects, features, details, utilities, and/or advantages of embodiments of the present disclosure will be apparent from reading the following description, and from reviewing the accompanying drawings.

DETAILED DESCRIPTION

Reference will now be made in detail to embodiments of the present disclosure, examples of which are described herein and illustrated in the accompanying drawings. While the present disclosure will be described in conjunction with embodiments and/or examples, it will be understood that they are not intended to limit the present disclosure to these embodiments and/or examples. On the contrary, the present disclosure is intended to cover alternatives, modifications, and equivalents.

Figure 1:
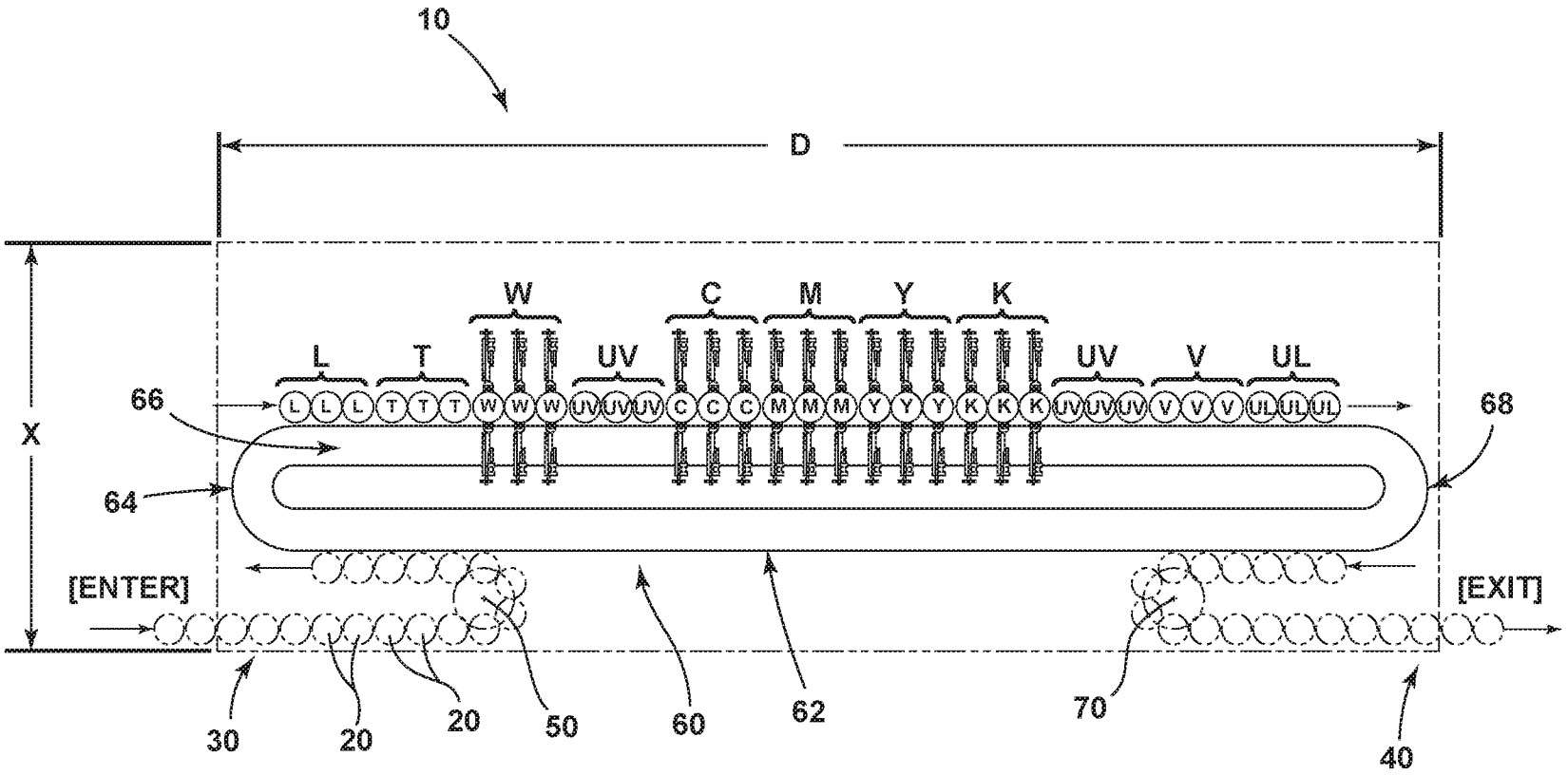
FIG. 1 is a top plan view diagram generally illustrating an embodiment of a digital printing system according to aspects and/or teachings of the present disclosure.

FIG. 1 generally illustrates an embodiment of a digital printing system 10. The digital printing system (or system) 10 may be configured to digitally print one or more layers or coats of ink, for example, on a plastic container 20. In an embodiment, such as generally illustrated in FIG. 1, a plurality of plastic containers (which may have cylindrical or flat portions) may enter the system 10 at a first location/area 30 (entrance) and, after printing, may exit the system at a second location/area 40 (exit)—which may be on an opposite end of the system 10. The system 10 may have a top plan footprint, such as that generally represented in FIG. 1 by dimensions D and X. With embodiments, dimension D may be two, three, or more times the dimension of dimension X. By way of example only, and without limitation, dimension D may be about 15 feet, and dimension X may be about 5 feet.

In embodiments, the containers 20 may be gripped (e.g., individually gripped) at or about their upper portions or necks by a mechanical device (such as a plurality of grippers that may be attached to a shuttle) and the containers may be conveyed about a track by such device(s). However, other forms of container conveyance, including a plurality of base cups or base holders, could also be utilized. With embodiments, the device(s) used to grip/convey containers may be configured to rotate the containers up to or more than 180 degrees—such as to present different portions of a container to various process steps/locations.

Without limitation, in an embodiment, the containers 20 may enter and be directed to a device 50 (which may include a wheel) that may convey or direct the containers onto a track 60 for subsequent processing. Device 50 may be configured to index or move/shift containers in desired groupings (as opposed to continuously moving containers through/along a system). For example, in the illustrated system of FIG. 1, containers 20 may be indexed or moved/shifted from a step or process location in groups of three containers.

In embodiments, the track 60 may, for example and without limitation, have a generally extended oval or oblong shape. Embodiments of a track may have a first generally straight portion/segment 62, a first curved portion/segment 64, a second generally straight portion/segment 66, and a second curved portion/segment 68. As generally illustrated in FIG. 1, in an embodiment of a system 10, containers may be conveyed or routed from device 50 onto a first generally straight portion/segment 62 of track 60 and around a first curved portion/segment 64. Various processing steps associated with the digital printing on the containers 20 may take place along or with respect to the conveyance of the containers along a second generally straight portion/segment 66. Following processing along portion/segment 66 of track 60, containers may be conveyed or routed to a second curved portion 68 and to a portion of first curved portion/segment 64 and may, if desired, be conveyed or routed to a device 70 (which may include a wheel) that conveys or routes the containers to second location/area 40 to exit the system 10.

In embodiments, such as generally illustrated in FIG. 1, various processing (or processing steps) may be conducted—such as shown about or along portion/segment 66. Letters within the containers generally represent the process that the container is exposed to or undergoing at the various positions along track 60. The various processing steps/locations may include, for example and without limitation, the following steps/locations shown in FIG. 1:

L=loading of containers

T=treatment or pre-treatment of containers (e.g., heat treatment, such as flame or plasma)

W=application of a base coat (e.g., a white or clear base coat)

UV=application of an ultraviolet light/energy

C=potential application of a first process color (e.g., cyan)

M=potential application of a second process color (e.g., magenta)

Y=potential application of a third process color (e.g., yellow)

K=potential application of a fourth process color (e.g., black)

V=vision or other inspection (e.g., a visual inspection)

UL=unloading of containers

The system 10 may, for example and without limitation, include the ability to print a plurality of different inks (or ink colors), including those commonly involved with color or process printing. Such colors commonly include cyan, magenta, yellow, and black.

In embodiments, the system may be configured to print (e.g., subsequently or substantially simultaneously) on opposing sides of a container. For example and without limitation, as generally illustrated in FIG. 1, print heads may be provided on opposite/opposing sides of a step/location—such as shown in connections with the steps/locations associated with steps/locations W, C, M, Y, and K.

Depending upon whether a base coat is intended or desired, the system 10 may eliminate or skip certain processes such as those shown in FIG. 1 (e.g., W and the first UV following W). Also, while the processing steps are primarily shown provided along the second generally straight portion/segment 66 of track 60, with other embodiments, processing steps (including those mentioned with respect to second generally straight portion/segment 66) or others may be provided along or about other portions of the track 60—such as along a portion of first curved portion/segment 64 and/or second curved portion/segment 68.

Figure 2:
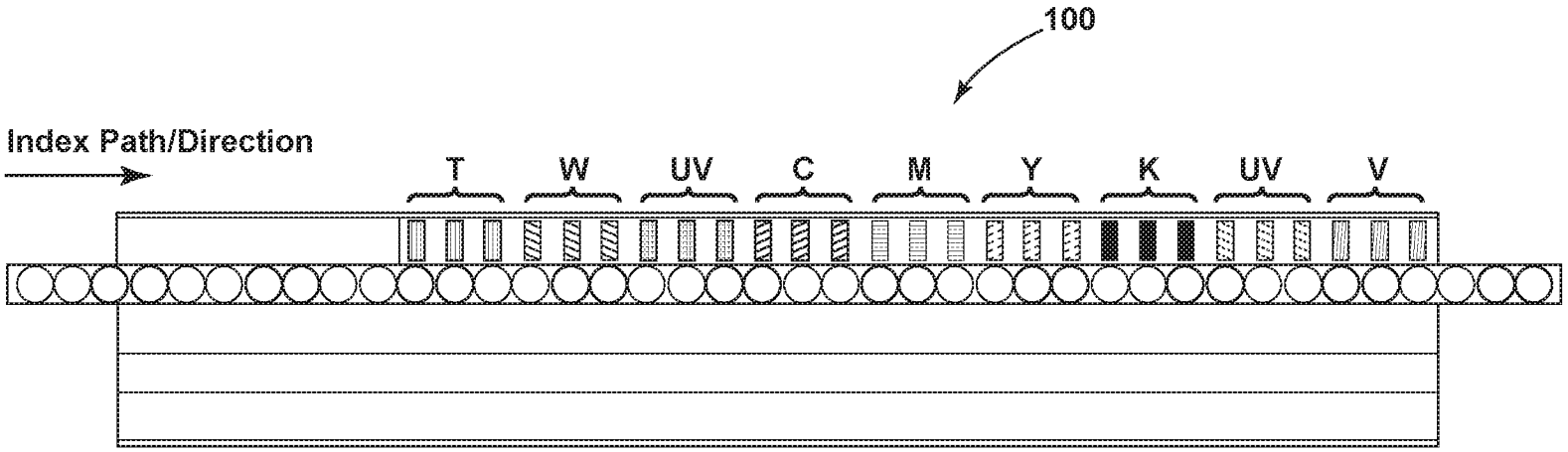
FIG. 2 is a top plan view diagram generally illustrating another embodiment of a digital printing system according to aspects and/or teachings of the present disclosure.

FIG. 2 generally illustrates another embodiment of a system 100 in which the containers may follow a substantially linear track past various processing steps/locations. In embodiments, the containers may be indexed or moved along the system 100 in groups of two containers.

Figure 3:
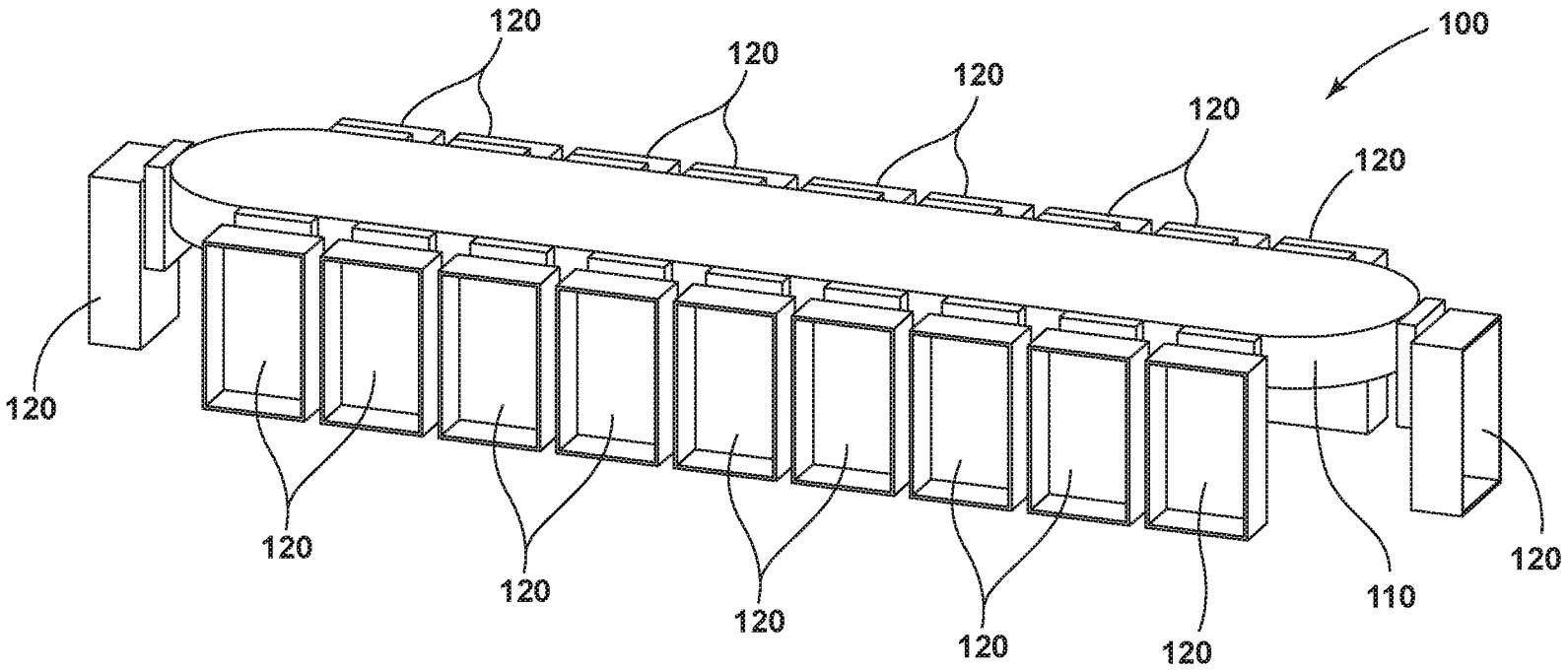
FIG. 3 is a perspective view of an embodiment of a digital printing system according to aspects and/or teachings of the present disclosure.
Figure 4:
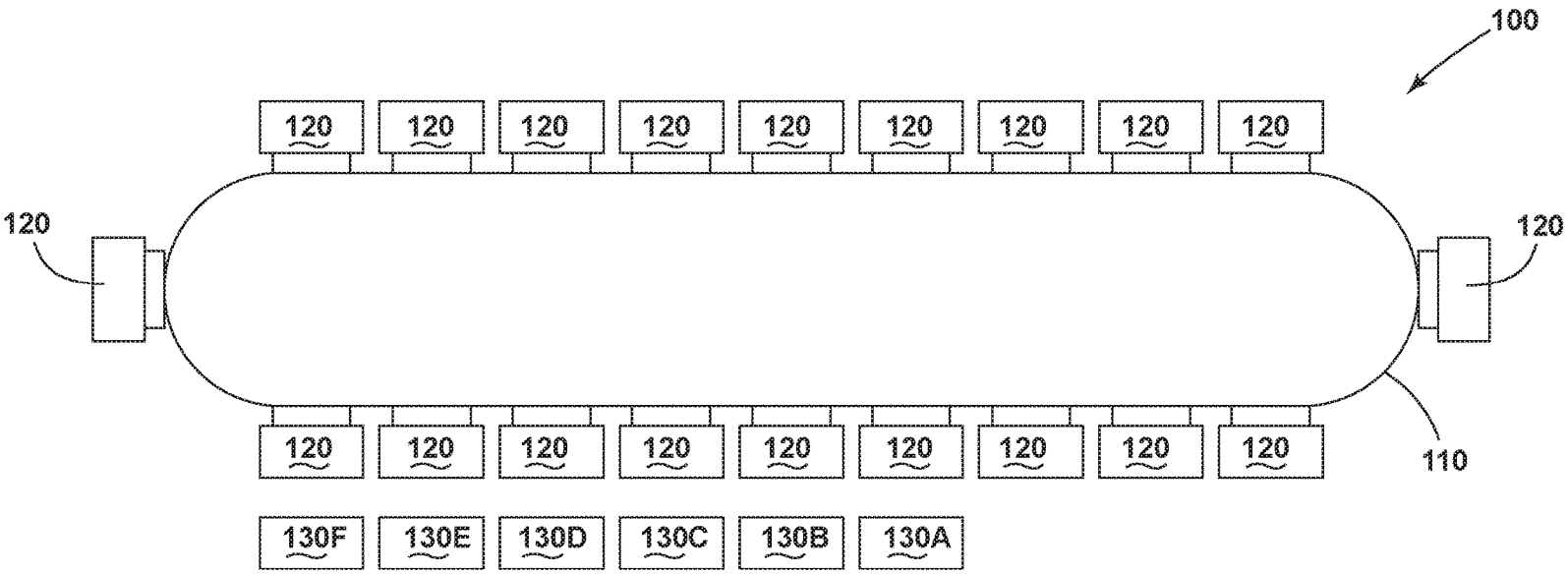
FIG. 4 is a top plan view of the embodiment of a digital printing system such as shown in FIG. 3.
Figure 5:
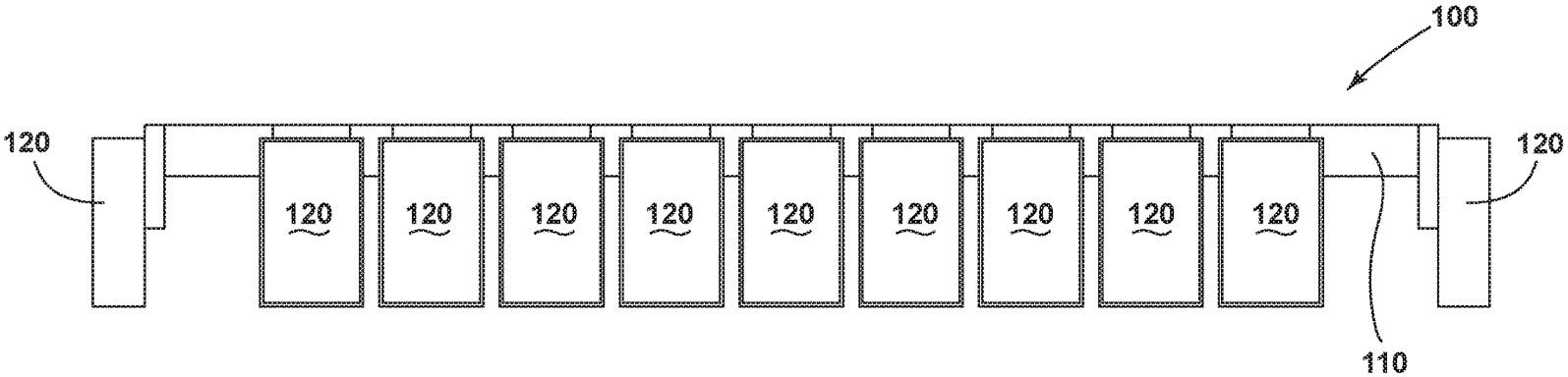
FIG. 5 is a side elevation view of the embodiment of a digital printing system such as shown in FIG. 3.

FIG. 3 generally illustrates another embodiment of a digital printing system 100. FIGS. 4 and 5 generally illustrate top plan and side views, respectively, of a digital printing system 100 such as shown in FIG. 3. The digital printing system (or system) 100 may be configured to digitally print one or more layers or coats of ink, for example, on a plastic container 20.

With embodiments, to optimize print head utilization, and to better maximize printer output, it can be desirable to reduce the amount of time that is consumed moving product in and out of print or printer position. With rotary print systems, a center wheel may be used to mount associated container carriers. The container carriers are typically spaced equally around the circumference of the wheel. With rotary systems, a large wheel diameter can be required in view of the associated size of the print hardware. However, a large wheel, with a large diameter, will typically have a comparatively large mass. That in turn can require greater inertial force, and necessitate substantial energy for controlling movement and indexing. Such systems can also require an undesirable amount of time associated with the indexing of the wheel, as well as issues associated with the torque demands of the system.

As appreciated in connection with the present disclosure, increasing print head utilization and/or increasing production output/throughput may involve, inter alia, a reduction in index speed associated with the containers. That may, for example, involve the reduction of mass associated with the associated movement and/or indexing of the containers to be printed. Among other things, an embodiment of the present disclosure comprises a plurality of container carriers, which may be independently controlled. Such independent container carriers may carry or transport a small number of containers, for example and without limitation, one, two, or three containers. Further, such container carriers may be comprised of comparatively light weight material (e.g., aluminum). Further, in contrast to hardware associated with rotary print systems (where the entire mass of the wheel must move together), utilizing container carriers, such as described herein, can reduce indexing time and optimize/maximize printhead utilization. Typical peak power of a rotary print system may be about 4600 W. Comparatively typical peak power of a container system according to teachings of the instant disclosure may be about 800 W (e.g., a reduction of more than 80%).

Such container carriers may be attachable (or coupled) and detachable (or de-coupled) to and from a track which may proceed past one or more print stations, which may involve one or more print heads. In embodiments, each container carrier may be attached or coupled to the track. For example and without limitation, each container carrier may be magnetically coupled to a servo track, which can allow for the individual control of the velocity and position along the track for each independent container carrier. An associated position controller may, for example, accelerate at very high rates (for example, about 18 $m/s^2$, as opposed to typical rotary print system maximum acceleration of about 3 $m/s^2$) and/or maintain very tightly toleranced positional accuracy. For example, in embodiments, the accuracy or repeatability may be about 100μ, may be about 50μ, and for some applications may be about 10μ or even less than 10μ.

By way of comparative example and without limitation, embodiments of the present disclosure can exhibit a significant increase in productivity when compared to a typical indexing wheel rotary print system.

Typical indexing wheel calculations may be generally as follows:

a) Index Time=1.124 s=t(i)

b) Print Time=0.935 s=t(p)

c) Total Cycle Time=t(t)=t(i)+t(p)=1.124 s+0.935 s=1.802 s d) Print Head Utilization=100×[t(p)/(t(p)+t(i))]=100×[0.935 s/(0.935 s+1.124 s)]=45.41%

In contrast, calculations for an embodiment of a digital printing system according to aspects or teachings of the present disclosure may be generally as follows:

a) Index Time=0.25 s=t(i)

b) Print Time=0.935 s=t(p)

c) Total Cycle Time=t(t)=t(i)+t(p)=0.25 s+0.935 s=1.185 s d) Print Head Utilization=100×[t(p)/(t(p)+t(i))]=100×[0.935 s/(0.935 s+0.25 s)]=78.90%

As demonstrated by the above calculations, a significant comparative reduction in index time with embodiments of the present disclosure can result in a print utilization percent that is significantly higher (e.g., as much or greater than 70%) when compared with a typical rotary index wheel system.

As generally illustrated in FIGS. 3-5, a digital printing system 100 according to an embodiment of this disclosure may comprise a track 110, a plurality of container carriers (which may also be referred to as shuttles) 120, and one or more print stations (which may include one or more print heads) 130. As generally illustrated in FIG. 4, a print station (which may comprise one or more print heads) 130 may be offset about the track 110 and may be disposed adjacent to a path of the plurality of container carriers 120. In embodiments, the print station and/or one or more associated print heads may be stationary, or may be movable (e.g., controllably positioned relative to the track or container carriers). In embodiments, one or more print heads may be associated with a print station, and such one or more print heads may be individually movable with respect to the track and/or container carriers. For example, with embodiments, print heads associated with print stations may be configured to be side-shooting, e.g., to apply ink in a direction that is substantially perpendicular to the process flow of containers to be printed. In embodiments, a print station 130 may comprise one or more print heads that may, for example, apply a base coat, apply an ink (e.g., a primary/process color, such as C (cyan), M (magenta), Y (yellow), or K (black)), and/or perform a curing function. For example and without limitation, with reference to FIG. 4, a plurality of print stations 130 may be provided about a track 110. While various print stations 130 may be provided and positioned in various configurations, in an embodiment, for example, a print station 130A may apply a base coat; another print station 130B may apply a first process color, such as cyan; another print station 130C may apply a second process color, such as magenta; another print station 130D may apply a third process color, such as yellow; another print station 130E may apply a fourth process color, such as black; and another print station 130F may perform a curing function. While only a few print stations 130 are illustrated, it is understood that embodiments of the disclosure may contain a plurality of print stations about an associated track, and the print stations may be configured in various sequences, banks of similar print stations, or other combinations, and such print stations may be changed/modified as desired.

An embodiment of a container carrier assembly 140, including a container carrier (or shuttle) 120 is generally illustrated in several views in FIGS. 6, 6A, 6B, and 6C. The container carrier 120 is shown in a configuration to accommodate two containers (each generally illustrated as container 200). However, the concept is not so limited, and other embodiments may accommodate various numbers of containers—for example and without limitation—two, three, four, or more containers. Moreover, as described further herein, a specific container carrier is not limited to transporting a single form or container, and may convey or transport different types, shapes, and sizes of containers at the same time.

Embodiments of a container carrier assembly 140 may include other components in addition to a container carrier 120. For example and as generally illustrated, a container carrier assembly 140 may include one or more base supports 150, one or more actuators 160 (e.g., push up actuators), one or more grippers 170 (e.g., neck grippers), and one or more encoders 180.

Figure 6A:
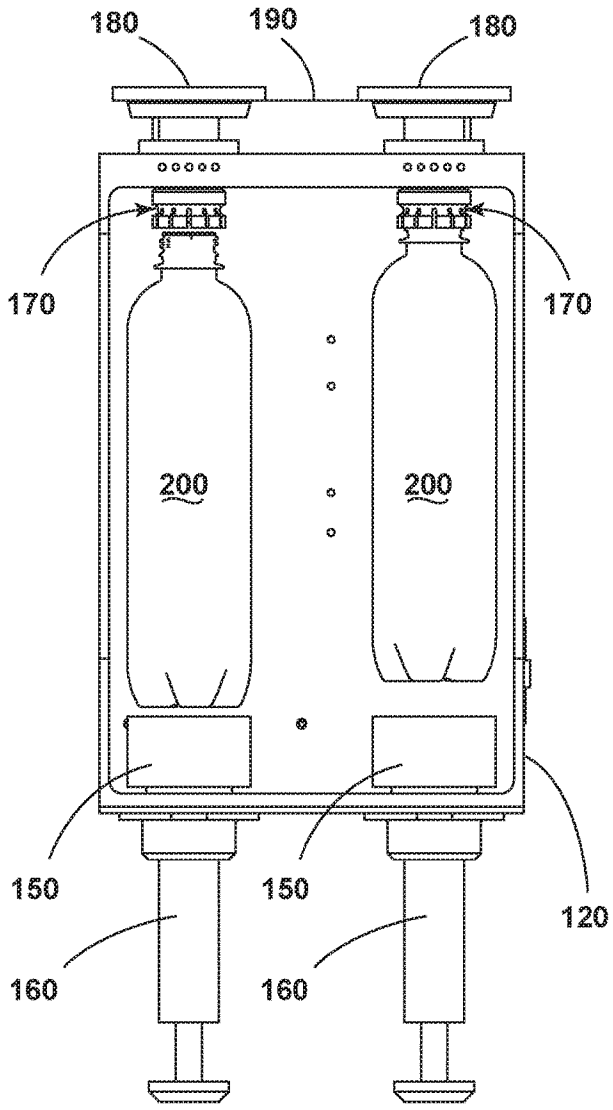
FIGS. 6A, 6B, and 6C are front, side, and rear elevation views, respectively, of the container carrier assembly shown in FIG. 6.
Figure 6:
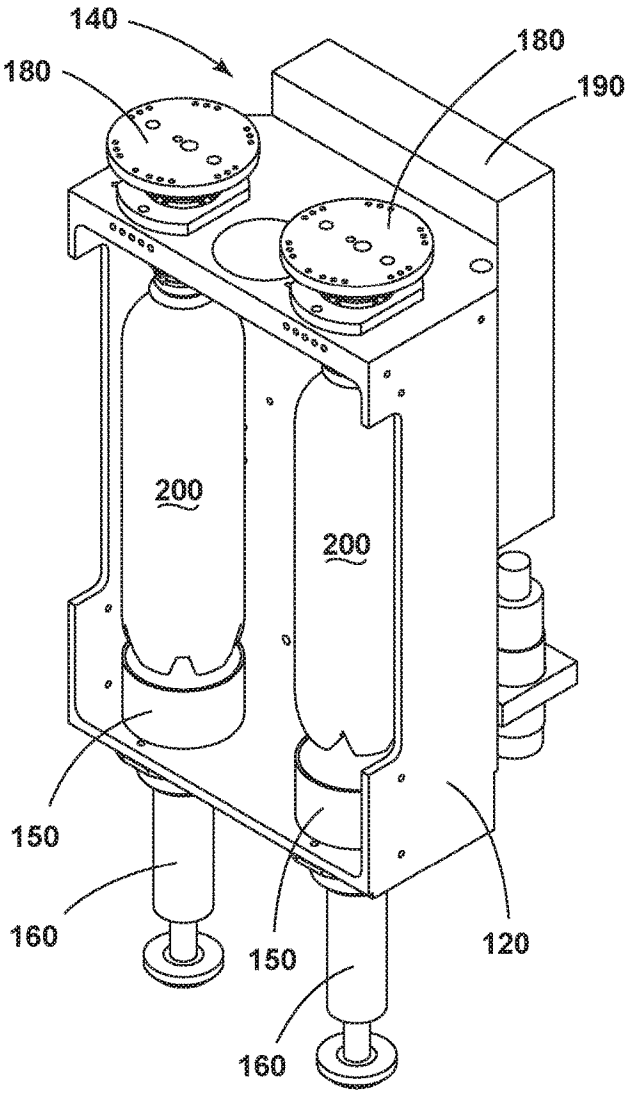
FIG. 6 is a perspective view of an embodiment of a container carrier assembly with a container carrier according to aspects and/or teachings of the present disclosure.
Figure 6C:
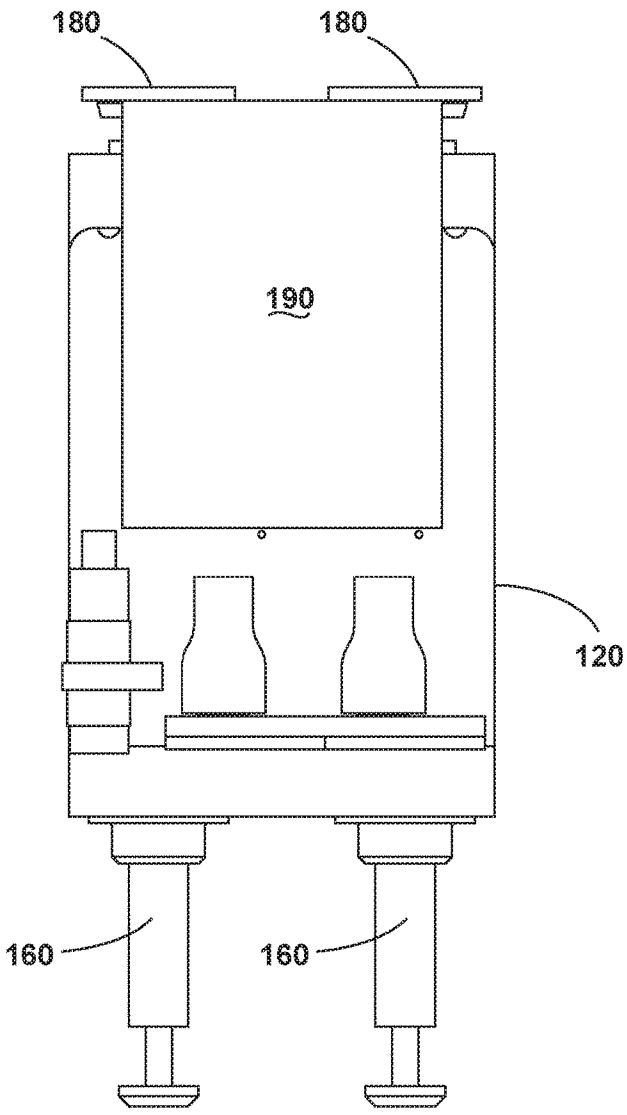

In embodiments, the base support 150 may be insertable and/or exchangeable and may be configured to accommodate a lower portion of various different containers. For example only, and as generally illustrated in FIG. 6, an embodiment of a base support 150 may comprise a base cup that is configured to accommodate a lower portion substantially circular base of a container.

With embodiments, one or more actuators 160 may be connected to a base support 150 and may be configured to rotate and/or vertically move (raise or lower) a base support (and hence a container if included or supported therein or thereby).

In embodiments, one or more grippers 170 may be configured to hold and/or retain a portion of a container (for example, and without limitation, a plastic bottle). For example, a gripper 170 may be configured to hold and/or retain a portion of a container, such as a neck portion of a container (e.g., at or about a support flange or tamper evident formation). Embodiments of a gripper 170 may be comprised, for example, of stainless steel, and/or may be configured to control a radial position/orientation of an associated container.

In embodiments, an encoder 180 may be operatively connected to a gripper 170. An encoder may, for example and without limitation, may control a radial position of a gripper (and hence a container held by a gripper), may receive power, and may transmit information (including for example via radio frequency (RF) or light data). In embodiments the container carrier assembly and/or an encoder may utilize, for example, inductive power or lithium ion power. Moreover, the power associated with each container carrier assembly may be charged or replenished at one or more print stations 130.

Figure 6B:
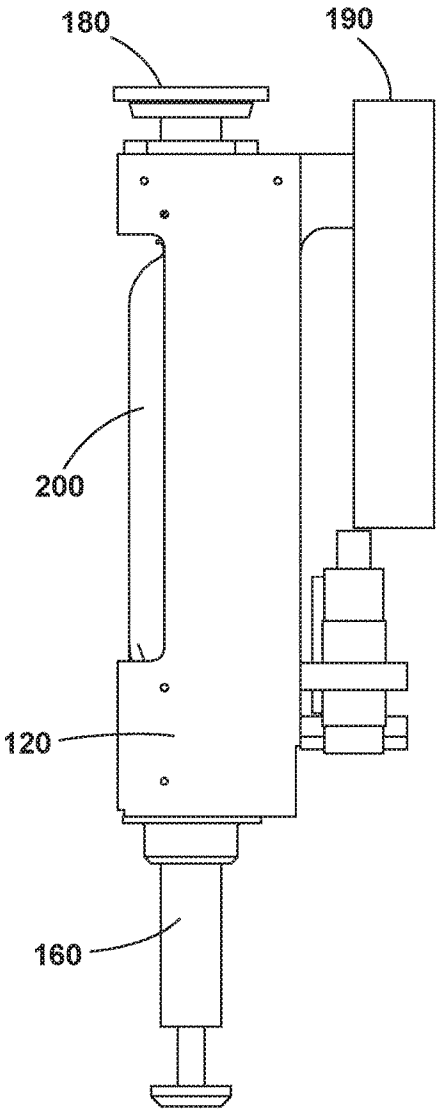

Further, as generally shown in FIG. 6B, a container carrier assembly 140 may include a rear formation 190. In embodiments, an associated rear formation 190 may be configured to be operatively connected or coupled to (and disconnected or de-coupled from) an associated track 110. For example and without limitation, the rear formation 190 may be magnetically coupled to the track 110, and may be coupled such that the track 110 (e.g., servo track) may individually control the velocity and/or position for each independent container carrier 120 along the track 110.

Figure 7A:
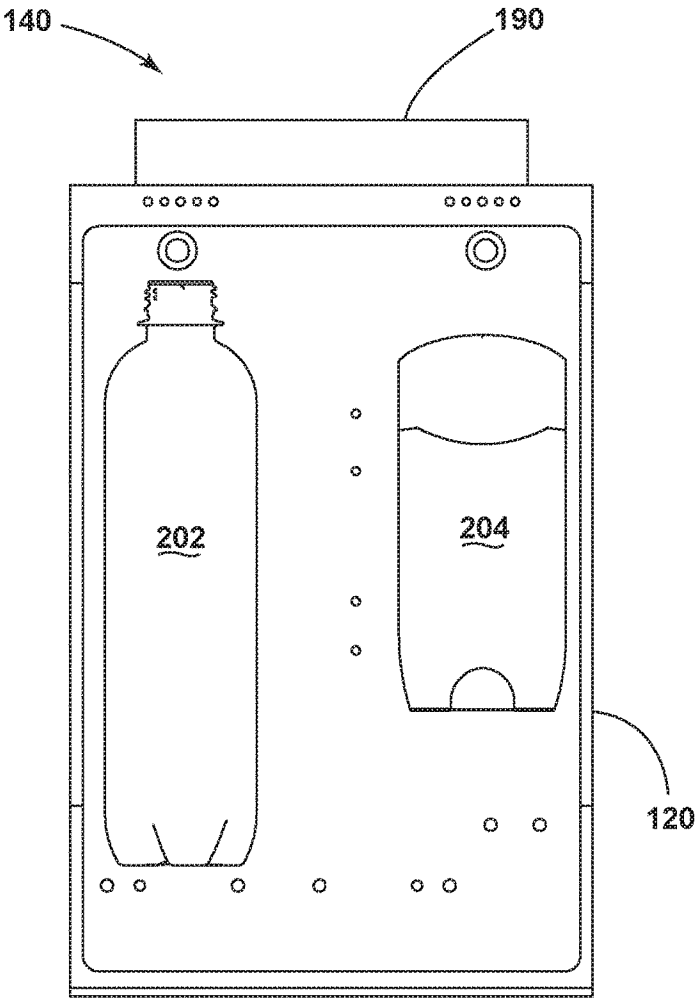
FIGS. 7A, 7B, and 7C are front, side, and top plan views, respectively, of the container carrier assembly shown in FIG. 7.
Figure 7:
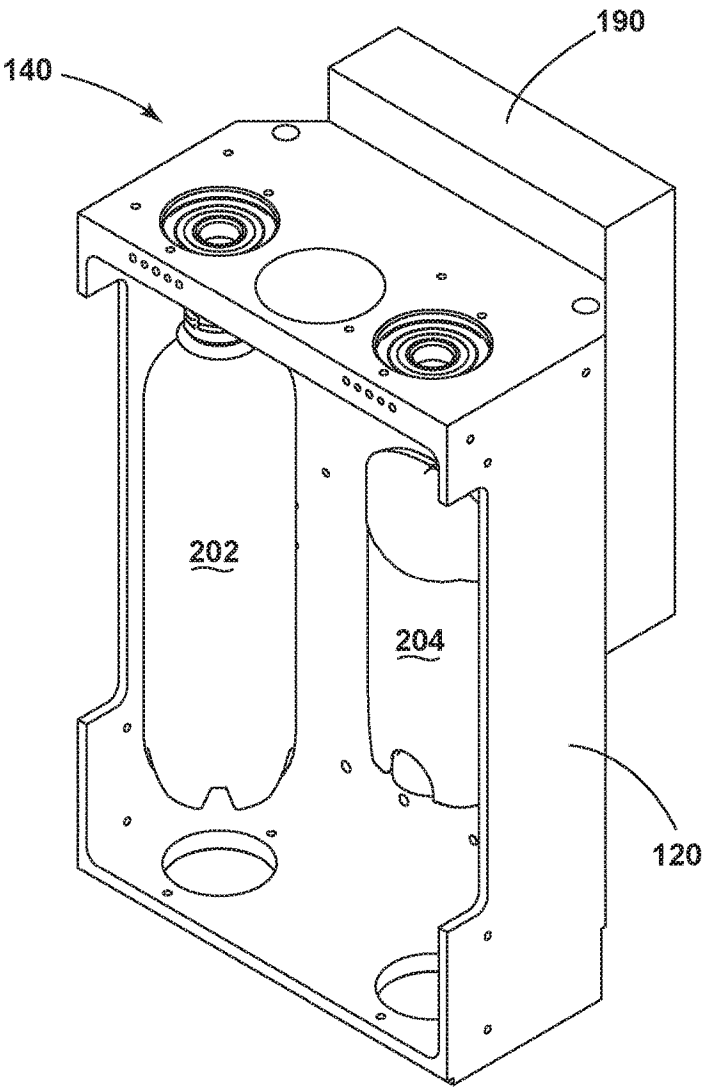
FIG. 7 is a perspective view of an embodiment of a container carrier assembly with a container carrier according to aspects and/or teachings of the present disclosure.
Figure 7C:
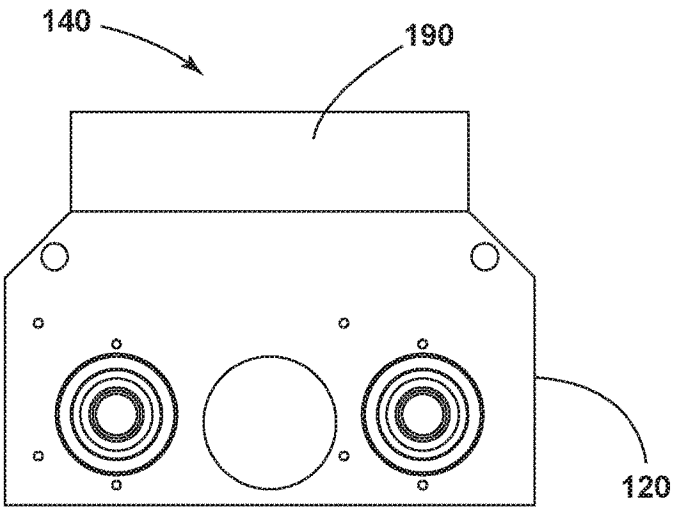
Figure 7B:
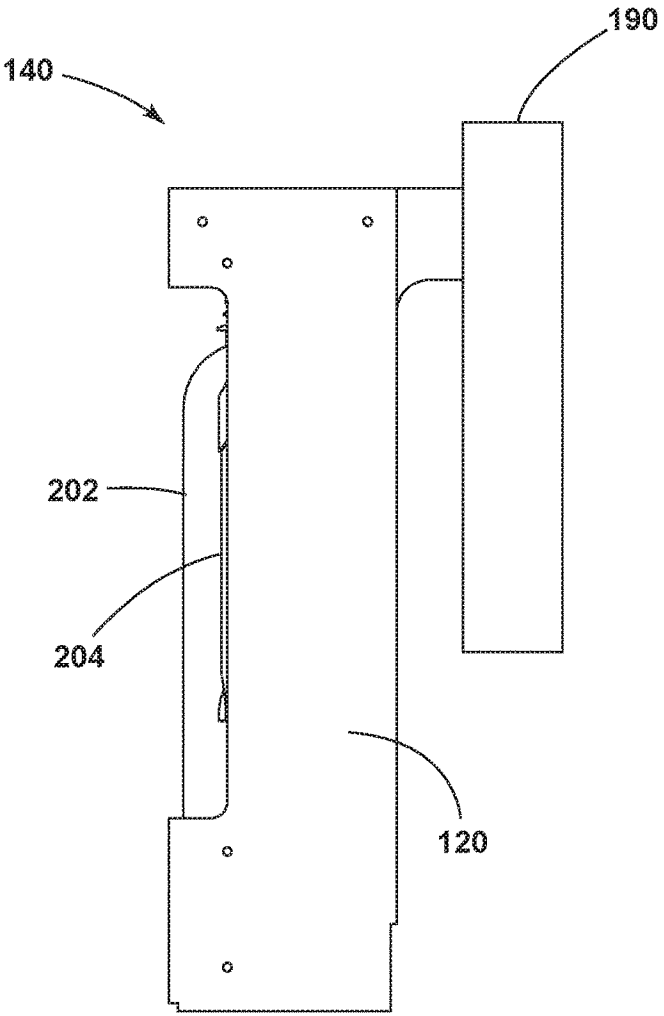
Figure 9:
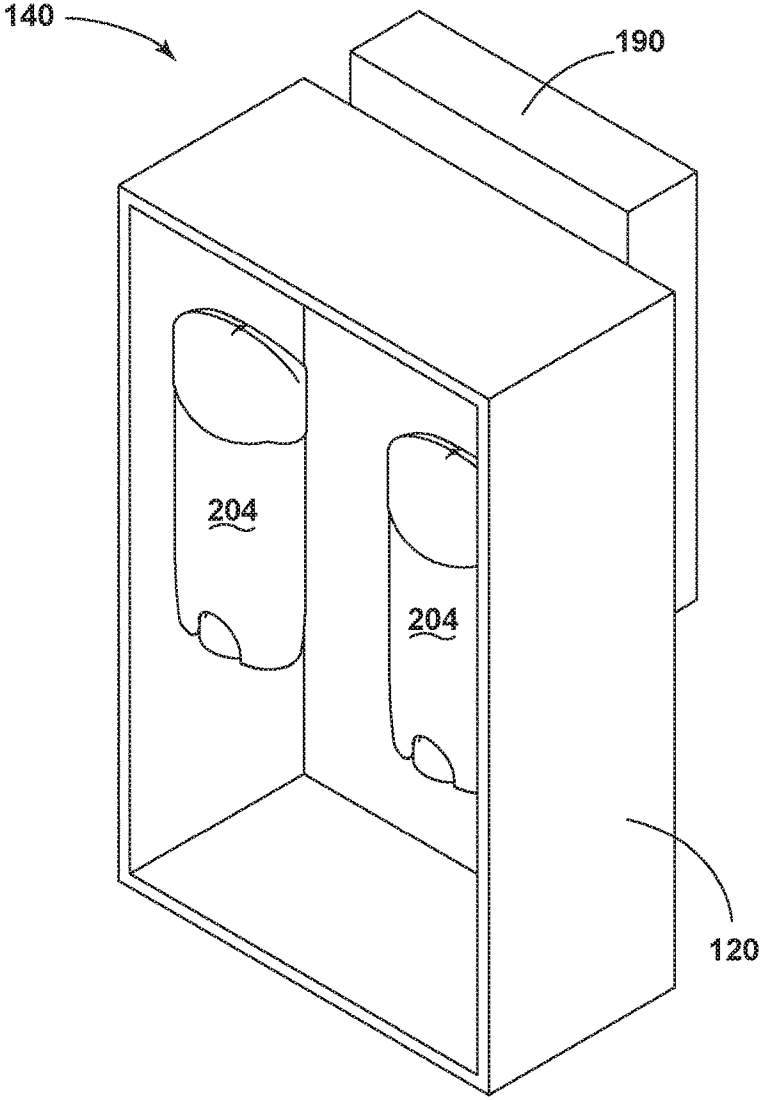
FIGS. 8 and 9 are perspective views generally illustrating a container carrier with different containers.
Figure 8:
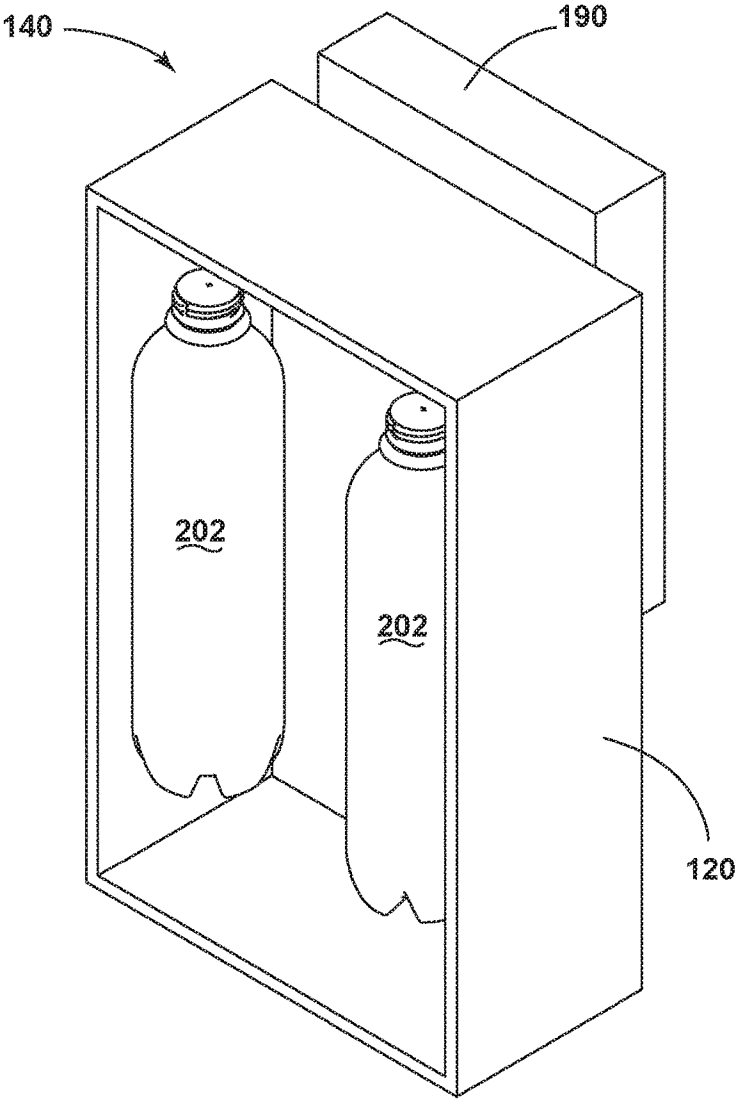

FIG. 6 generally illustrates an embodiment of a container carrier 120 configured to carry or transport two items—i.e., two containers 200—for printing in a digital print system. Such containers 200 may, for example and without limitation, each comprise a generally cylindrical plastic container of bottle. However, the disclosure is not limited to use (and printing upon) of specific containers and, as generally illustrated in FIG. 7, other types, shapes, and sizes of containers, including non-round containers—such as the container depicted as container 204 (e.g., a deodorant container)—may also be carried or transported via a container carrier 120. Thus, with embodiments of the present disclosure, a container carrier 120 may be configured to carry identical containers; containers of the same general type or form, but of different sizes; or completely different containers. FIGS. 8 and 9 generally illustrate how different containers may be transported in a similar container carrier 120. Again, while container carriers are shown configured to carry two items, the concept is not so limited, and the container carriers may carry one or more than two items (e.g., containers) for printing, and various differently-configured individual container carriers may be used with the same digital printing system.

In contrast with typical rotary printing systems, which generally run at a constant velocity throughout, embodiments of the disclosed digital printing system can run at different speeds or velocities. Moreover, embodiments of the disclosed digital printing system can be modular and flexible. That is, for example, the system can add or take away container carriers, and container carriers can be included in the system in various combinations (as to desired printing and/or types of containers), and can be run in various combinations, as well as in sequence or in parallel.

With embodiments, when the system is moving the container carriers may not be powered. One or more various motors may be fixed at different processing locations/stations about a track. When a container carrier (with containers for printing) arrive at a print station and/or where a motor is located, there may be a power exchange engagement with the container carrier and/or other relevant components.

Various embodiments are described herein for various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "with embodiments," "in embodiments," or "an embodiment," or the like, means that a particular feature, structure, or characteristic described in connection with the embodiment is included in at least one embodiment. Thus, appearances of the phrases "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." in the specification is to be construed broadly and is used to provide non-limiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are intended to be inclusive unless such a construction would be illogical.

While examples of dimensions of certain components may be described herein, such dimensions are provided as non-limiting examples and the components may have other dimensions.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

It is intended that all matter contained in the above description or shown in the accompanying drawings shall be interpreted as illustrative only and not limiting. Changes in detail or structure may be made without departing from the present disclosure.

What is claimed is:

1. A digital printing system comprising:

a track configured to convey a plurality of containers to or through a plurality of process locations; and a plurality of print heads configured for digital printing on the plurality of containers, the plurality of print heads extend linearly along a portion of the track in a direction of flow of the plurality of containers along the track;

wherein the plurality of print heads are separated from and horizontally offset from the track, and the digital printing system is configured to index sets of the plurality of containers in a line to or through the plurality of process locations, the process locations extending in a line substantially parallel with the line of an indexed set of the plurality of containers, with the indexed set of the plurality of containers presented in a vertical container orientation to the plurality of print heads for digital printing and without vertical repositioning of the plurality of print heads relative to a container presented for printing; and movement of the plurality of containers is controlled or limited at an upper portion and a lower portion of the plurality of containers.

2. The digital printing system of claim 1, wherein the track has an extended oval or oblong configuration.

3. The digital printing system of claim 1, wherein the process locations include process locations that treat or pre-treat the containers, apply a base coat, apply one or more process colors, and apply ultraviolet light/energy.

4. The digital printing system of claim 1, wherein the plurality of print heads include print heads provided on opposite or opposing sides at positions along the track, with opposing print heads configured to print in a direction substantially perpendicular to the track.

5. The digital printing system of claim 1, wherein the containers are indexed to a successive process location in index sets comprising two or more containers.

6. The digital printing system of claim 1, wherein the containers enter and exit the track at opposite ends of the track.

7. The digital printing system of claim 1, wherein at least one process location includes electronic or machine vision or inspection.

8. A digital printing system comprising:

a track;

a plurality of print stations positioned along or about portions of the track;

a plurality of container carriers, each container carrier configured to operatively connect to the track and to move with or along the track to or by one or more of the plurality of print stations, the plurality of print stations are not connected to the plurality of container carriers and the plurality of print stations are horizontally offset from the track;

wherein the container carriers are configured to convey one or more containers; the container carriers are configured to hold or restrain one or more containers at an upper portion and a lower portion of the one or more containers, and a least one of the plurality of print stations includes one or more print heads; the one or more print heads are horizontally offset from the track and extend linearly along a portion of the track in a direction of a flow of the plurality of container carriers linearly in succession along the track; and the container carriers are each configured to transport or convey at least two containers.

9. The digital printing system of claim 8, wherein the one or more print heads are stationary.

10. The digital printing system of claim 8, wherein one or more print heads are movable.

11. The digital printing system of claim 8, wherein one or more print heads are configured for side-shooting.

12. The digital printing system of claim 8, wherein at least one print station applies a base coat, and at least one print station applies an ink.

13. The digital printing system of claim 12, wherein at least one print station performs a curing function.

14. The digital printing system of claim 8, wherein a print station is configured to apply a base coat, another print station is configured to apply a first process color, another print station is configured to apply a second process color, another print station is configured to apply a third process color, another print station is configured to apply a fourth process color; and at least one other print station is configured to perform a curing function.

15. The digital printing system of claim 8, wherein the container carriers include one or more actuators connected to a base support and configured to rotate and/or vertically move the base support.

16. The digital printing system of claim 8, wherein the at least two containers may not be identical containers.

17. The digital printing system of claim 8, wherein the container carriers are part of a container carrier assembly; the container carrier assembly further includes one or more of the following: one or more base supports, one or more actuators, one or more grippers, and one or more encoders; the one or more actuators control or limit movement of the one or more containers from the lower portion of the containers; and the one or more grippers control or limit movement of the one or more containers from the upper portion of the containers.

18. The digital printing system of claim 17, wherein the container carrier assembly includes a rear formation that is configured to be operatively coupled or connected to the track.

19. The digital printing system of claim 18, wherein the rear formation is magnetically coupled to the track.

20. The digital printing system of claim 8, including one or more grippers configured to hold and/or retain a portion of a container.

21. The digital printing system of claim 20, including one or more encoders operatively connected to one or more grippers configured to independently rotate one or more containers.

22. The digital printing system of claim 21, wherein the one or more encoders control a radial position of the one or more grippers, receive power, and/or transmit information.

23. The digital printing system of claim 8, wherein the track has an extended oval or oblong configuration.

24. The digital printing system of claim 8, wherein the track comprises a servo track.

25. The digital printing system of claim 24, wherein the container carriers are magnetically coupled to the track, and the system is configured to control a velocity and/or a position of each container carrier along the track.

* * * * *